US005740884A

United States Patent [19]

DiMucci et al.

[11] Patent Number: 5,740,884

[45] Date of Patent: *Apr. 21, 1998

[54] POWER LIFTING UNIT AND METHOD FOR CONVERTING MOBILE PATIENT TRANSPORTER

[76] Inventors: Vito A. DiMucci; Michael V. DiMucci, both of 14343 Old Wood Rd., Saratoga, Calif. 95070

[ * ] Notice: The term of this patent shall not extend beyond the expiration date of Pat. No. 5,495,914.

[21] Appl. No.: 418,394

[22] Filed: Apr. 7, 1995

Related U.S. Application Data

[63] Continuation-in-part of Ser. No. 103,851, Aug. 9, 1993, Pat. No. 5,495,914.

[51] Int. Cl.[6] ..... A61G 1/02

[52] U.S. Cl. ..... 182/141; 5/611

[58] Field of Search ..... 182/141; 5/611; 248/421

[56] References Cited

U.S. PATENT DOCUMENTS

| | | | |
|---|---|---|---|
| 2,833,587 | 5/1958 | Saunders | 296/20 |
| 2,958,873 | 11/1960 | Ferneau | 5/11 |
| 3,380,085 | 4/1968 | Ferneau et al. | 5/86.1 |
| 3,743,344 | 7/1973 | Jameson | 296/20 |
| 3,982,718 | 9/1976 | Folkenroth et al. | 248/421 |
| 4,435,862 | 3/1984 | King et al. | 5/611 |
| 4,685,731 | 8/1987 | Migut | 248/421 |
| 4,860,394 | 8/1989 | Benessis et al. | 5/611 |
| 5,022,105 | 6/1991 | Catoe | 296/20 |
| 5,135,350 | 8/1992 | Eelman et al. | 296/20 |
| 5,271,113 | 12/1993 | White | 5/611 |
| 5,279,011 | 1/1994 | Schnelle | 5/611 |
| 5,285,992 | 2/1994 | Brown | 248/421 |

*Primary Examiner*—Alvin C. Chin-Shue

*Attorney, Agent, or Firm*—Skjerven, Morrill, MacPherson, Franklin & Friel LLP

[57] ABSTRACT

A compact, lightweight, power lifting unit assists the operator of a mobile patient transporter in raising or lowering the patient bed to the desired height required in transporting or transferring a patient. The power lifting unit may also be used to "collapse" the transporter. The power lifting unit uses a ball screw and ball nut to convert the rotary motion of an electric motor to the linear motion necessary to drive a tension arm and raise or lower the transporter. The power lifting unit is adaptable and may be installed on virtually any existing transporter.

25 Claims, 2 Drawing Sheets

POWER LIFTING UNIT AND METHOD FOR CONVERTING MOBILE PATIENT TRANSPORTER

CROSS-REFERENCE TO RELATED APPLICATIONS

This application is a continuation-in-part of U.S. application Ser. No. 08/103,851, filed Aug. 9, 1993, entitled "POWER LIFTING UNIT AND METHOD FOR CONVERTING MOBILE PATIENT TRANSPORTER" by Vito A. DiMucci and Michael V. DiMucci, now U.S. Pat. No. 5,495,914 issued Mar. 5, 1996.

FIELD OF THE INVENTION

This invention relates to a power lifting unit for adjusting the height of a "gurney" or mobile patient transporter used, for example, to transport patients to or from a health care facility.

BACKGROUND OF THE INVENTION

It is frequently necessary to transport patients to or from a hospital or from one area within a health care facility to another part of the health care facility. In transporting patients, operators (usually two Emergency Medical Technicians) are routinely required to physically lift the transporter carrying the patient. This places the operators at a high risk of significant and even crippling back injuries, particularly in the field where regular hospital facilities are not available.

The transporters used to move patients from one location to another within a health care facility are frequently expensive, heavy duty devices which are unsatisfactory for use in the field. These intrahospital transporters usually must be connected to an electrical outlet in order to adjust the position or height of the transporter for the patient's comfort or for transferring the patient to or from an operating table or other medical apparatus.

While various attempts have been made to reduce the back stress and the risk of back injury to transporter operators, no lightweight, compact, cost effective, and adaptable power-assisted mobile patient transporter is presently available. Present power-assisted lifting mechanisms for transporters typically suffer from the following or similar disadvantages:

a. In U.S. Pat. No. 5,022,105, entitled "Mobile Lift-Assisted Transport Device For Field Use" a lifting mechanism powered by high-pressure compressed air or oxygen is used to adjust the height of a transporter. However, compressed air is not readily available to operators, and compressed oxygen is expensive and poses an added risk to the patient and the operators in hazardous emergency situations. Also, compressed air or oxygen cylinders are heavy and cumbersome.

b. In U.S. Pat. No. 2,833,587, entitled "Adjustable Height Gurney", a manually powered hydraulic lifting mechanism is used to raise or lower the bed frame of a transporter. Such a manual hydraulic system is both slow and relatively heavy. Moreover, using a battery powered hydraulic system, which includes one or more hydraulic cylinders, a hydraulic pump and pump motor, high pressure fittings and hoses, controls, and a relatively large battery unduly increases the weight of the transporter.

c. A transporter lifting mechanism using an acme or trapezoidal lead screw is inefficient, since these types of lead screws require considerable force to overcome the inherent sliding friction of the lead screw threads against the nut. Thus, relatively large motors are required to provide sufficient torque. If a battery powered electric motor is used to drive such a lifting mechanism, relatively large batteries are required and battery life is reduced.

There are a large number of existing, manually operated transporters currently in use. Any power-assisted lift mechanism which cannot be adapted to an existing transporter, but would instead require the purchase of a new transporter having a built-in power lifting unit, would needlessly increase the cost of medical care.

SUMMARY OF THE INVENTION

In accordance with the present invention, a compact, lightweight, inexpensive power lifting unit assists the operator of a mobile patient transporter in raising or lowering the patient bed to the desired height required in transporting or transferring a patient. The power lifting unit may also be used to "collapse" the transporter. For example, in loading the transporter into an ambulance, the upper bed frame is supported at the head end by the ambulance floor and at the foot end by the operator. The lifting unit then raises the lower frame to "collapse" the transporter.

In one embodiment of the invention, the force required to raise the transporter bed frame is applied to the transporter frame by one or more separate tension arms. This is to be contrasted with existing designs in which the force is transmitted through the transporter frame itself, making it necessary to use a sturdier or reinforced frame and increasing the weight of the transporter.

In another embodiment, the power lifting unit uses a ball screw and ball nut to convert the rotary motion of an electric motor to the linear motion necessary to drive the tension arm and raise or lower the transporter. The ball screw and nut is extremely efficient in converting rotary motion to linear motion and produces a high linear thrust. Thus, the power needed to drive the lifting mechanism is greatly reduced, allowing the use of a much smaller electric motor (e.g., a 12-volt d.c. gear motor). This in turn permits the use of a much smaller, rechargeable battery as a power supply and increases the number of lifting operations between battery recharging or replacement. Even more importantly, the weight of the transporter is significantly reduced.

The power lifting unit is adaptable and easily installed on virtually any existing transporter. Interlocks and safety features may be provided which require the operator to be in the desired operating position to safely control the transporter before any lifting or loading action can be initiated. The lifting unit is compact and weighs less than 20 pounds, but is capable of reducing the lifting effort required by the operator to less than 20 percent of the effort normally required.

DETAILED DESCRIPTION

Figure 1A:
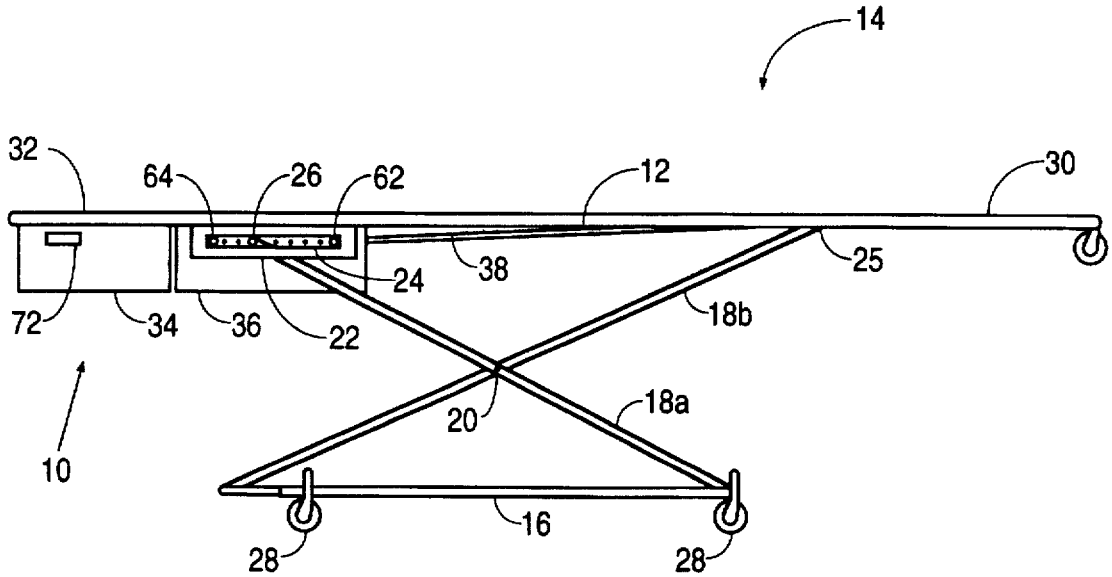
FIG. 1*a* is a side view illustrating one embodiment of a power lifting unit according to the present invention, installed on a mobile patient transporter.

FIG. 1*a* is a side view illustrating one embodiment of a power lifting unit 10 according to the present invention, installed on the underside of the upper frame member 12 of a mobile patient transporter 14. It should be understood that mobile patient transporters are sufficiently well known in the art that the features of the transporter 14 are not shown in detail in the drawings. Although the different kinds of existing transporters may vary slightly in their construction, virtually any existing transporter may be easily adapted for the installation of the power lifting unit 10 of the present invention, as will be described below. In order to describe the operation of the power lifting unit 10, it is sufficient to describe the transporter 14 as having (a) a lower frame member 16, (b) a pair of side frame members 18*a* which are pivotally connected to a second pair of side frame members 18*b* at the pivot point 20, (c) an upper frame member 12, (d) a bracket 22 with a slot 24 therein, attached to one side of the upper frame 12 near one end of the upper frame, (e) a support arm (not shown, but having a longitudinal axis 25) connecting the upper ends of the pair of side frame members 18*b*, and (f) a sliding arm 26 connecting the upper ends of the pair of side frame members 18*a* and having a protruding end which slides back and forth within the slot 24. Alternatively, two slotted brackets 22 may be used, one on either side of the upper frame 12. The upper ends of the pair of side frame members 18*b* are pivotally connected to the upper frame 12. The lower ends of both pairs of side frame members 18*a*, 18*b* are pivotally connected to the lower frame 16. One or both pairs of side frame members 18*a*, 18*b* may be telescoping members. Alternatively, the lower ends of the pair of side frame members 18*b* may be slidably as well as pivotally connected to the lower frame 16 in order to allow the side frame members 18*a*, 18*b* to pivot about the pivot point 20 when the upper frame 12 is raised or lowered. A "detent" or locking mechanism (not shown) mounted on the upper frame 12 is used to secure the transporter 14 in a stationary position after the upper frame 12 has been raised or lowered to the desired height. Wheels 28 mounted on the lower frame member 16 enable the operator to easily move the transporter 14. The transporter 14 is used to carry a patient (not shown) on a bed frame mounted on the upper frame 12, with the patient's head at the head end 30 and the patient's feet at the foot end 32.

Figure 2:
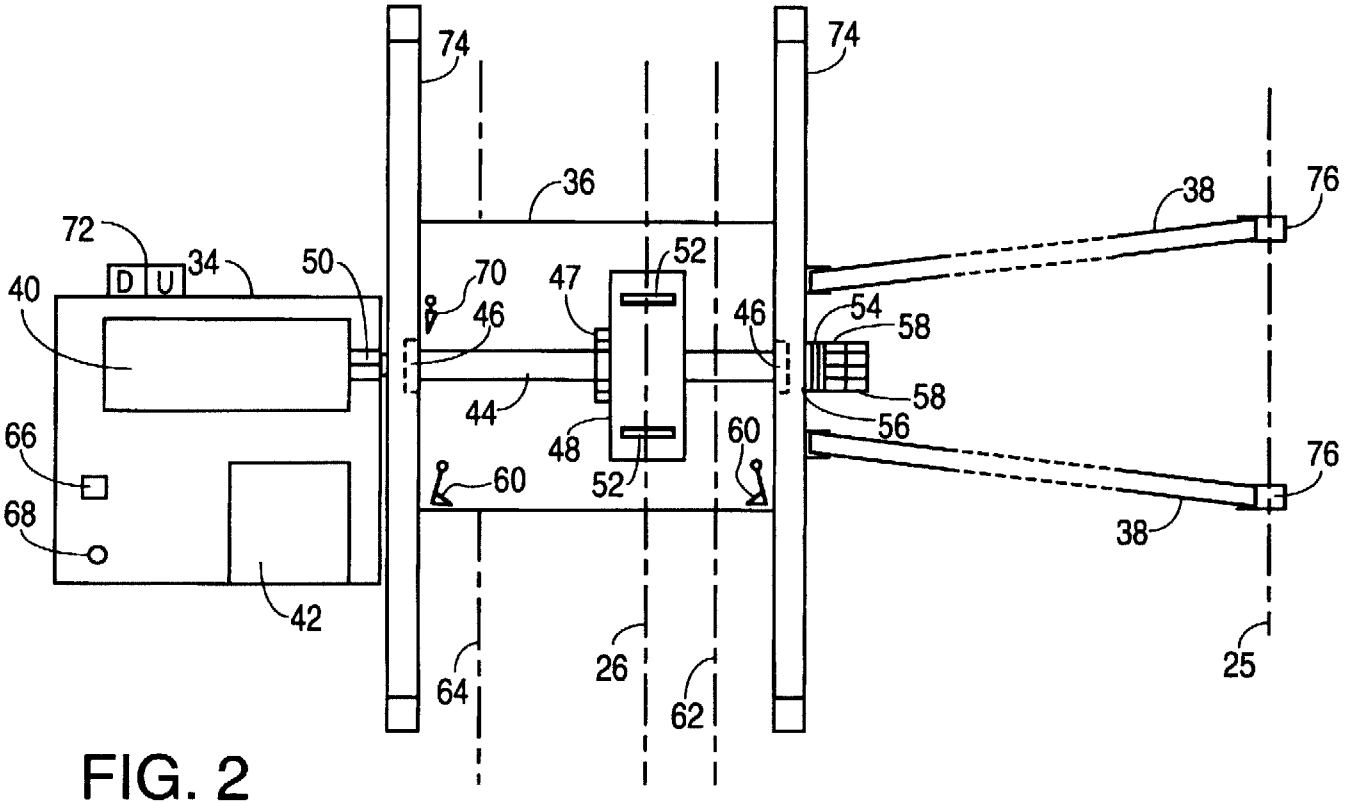
FIG. 2 is a top view illustrating one embodiment of a power lifting unit according to the present invention.

In FIG. 1*a*, the power lifting unit 10 includes a drive unit 34, a drive train 36, and a pair of tension arms 38, which are shown in FIG. 2 in more detail. The drive unit 34 includes an electric motor 40 (e.g., a 12-volt d.c. gear motor). Because of its small size, the electric motor 40 may be powered by a portable rechargeable battery 42. The rechargeable battery 42 is connected to the electric motor 40 using a quick disconnect connector, so that the battery 42 may be easily removed, recharged, and reinstalled. A spare rechargeable battery 42 can be kept in a recharger in the van or other vehicle carrying the transporter. Mobile transporter vans are typically equipped with 110-volt a.c. outlets which can be used for recharging the battery 42.

Figure 1B:
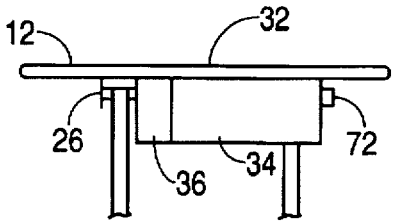
FIG. 1*b* is a foot-end view showing the power lifting unit installed on a mobile patient transporter.
Figure 3:
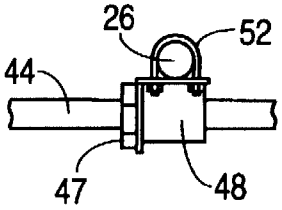
FIG. 3 is a side view showing the nut and flange assembly of the power lifting unit.

The drive train 36 includes a lead screw 44 supported at both ends by radial bearings 46. The lead screw 44 is engaged by a nut 47 which is part of a nut and flange assembly 48 (shown in greater detail in FIG. 3). One end of the lead screw 44 is coupled by a shaft coupling 50 to the drive shaft of the electric motor 40. Rotation of the lead screw 44 by the electric motor 40 drives the nut and flange assembly 48 axially (to the left or the right) along the lead screw 44. The nut and flange assembly 48 is attached to the sliding arm 26 of the transporter 14 (FIGS. 1 and 3) by means of fasteners 52 (e.g., U-clamps or saddles), so that the sliding arm 26 is also driven to the left or the right. For example, driving the nut and flange assembly 48 to the right (toward the head end 30 (FIG. 1*a*) of the bed frame) forces the sliding arm 26 to the right. Since the sliding arm 26 is attached to the upper ends of pivotable side frame members 18*a*, the frame members 18*a* are pivoted clockwise about pivot point 20. The force driving the sliding arm 26 to the right is opposed by a tensile force transmitted by the lead screw 44 (through the thrust bearing 54 and the drive train housing 56) to the tension arms 38 which are pivotally connected to the housing 56 (FIG. 2). The thrust bearing 54 is secured to the lead screw 44 by jam nuts 58. Since the tension arms 38 are pivotally connected to the support arm (not shown, but having a longitudinal axis 25) which braces the upper ends 59 of pivotable side frame members 18*b*, the tensile force tends to pivot the frame members 18*b* counterclockwise about pivot point 20. Thus, when sliding arm 26 is driven to the right (toward end 30) by lead screw 44 and nut and flange assembly 48, both pairs of side frame members 18*a* and 18*b* are pivoted so that the upper frame 12 is raised to the desired height.

In one embodiment, the lead screw 44 is a ball screw which is extremely efficient in converting the rotary motion of the electric motor 40 to linear motion and producing a high linear thrust.

Limit switches 60 automatically turn off the drive unit 34 when the sliding arm 26 reaches a predetermined position corresponding to either the uppermost position 62 or the lowermost position 64 of the transporter. An audible alarm 66 indicates up/down movement, low battery, and uppermost or lowermost limit positions. An indicator light 68 provides a further indication of a low battery condition.

In one embodiment, a manual locking handle (not shown) and associated switch 70 operate in conjunction with a momentary contact up/down switch 72 to ensure that the drive unit 34 operates only when the operator is correctly positioned to safely control the transporter. The well-known manual locking handle engages and disengages a locking mechanism (not shown) which allows the transporter to be set at any of several different heights. Bed frame supports 74 attached to the drive train housing 56 support the patient bed.

Any existing transporter 14 having a sliding arm 26 connecting frame members 18*a* and a support arm (not shown, but having a longitudinal axis 25) connecting frame members 18*b* can be easily adapted by installing the power lifting unit 10 of the present invention. Installation of the power lifting unit 10 simply requires (a) connecting the nut and flange assembly 48 to the sliding arm 26 with fasteners 52 such as U-clamps, and (b) pivotally connecting the tension arms 38 to the support arm with fasteners 76 such as U-clamps or yokes. The lengths of the tension arms 38 are adjustable in a well known manner to assure that the power lifting unit 10 may be installed on virtually any existing transporter 14.

The above description is intended to be illustrative and not restrictive. Many variations of the invention will become apparent to those of skill in the art upon review of this disclosure. Merely by way of example, the power lifting unit of the present invention has been illustrated in relation to a mobile patient transporter, but it will be apparent to those of skill in the art that the invention may readily be applied to desks, tables, benches, ladders, stools, construction scaffolding, and the like. Further, bearings and other friction reducing devices may be used at various load points to improve efficiency and reduce the power required to operate the lifting unit. Still further, protective housings, sleeves, or shields may be used for increased safety and ease of maintenance. The scope of this invention should, therefore, be determined with reference to the appended claims along with their full scope of equivalents.

What is claimed is:

1. A power lifting unit apparatus for adjusting the height of a gurney, the gurney having a platform with a top surface for holding a person and a bottom surface, an undercarriage containing wheels, and means connecting said platform to said undercarriage by using a scissors-like structure, said apparatus comprising:

an electric motor;

lead screw assembly including a lead screw capable of being driven by said motor;

a threaded assembly engaged with said lead screw and capable of being slidably mounted on said bottom surface such that when said lead screw is rotated in a first direction, the threaded assembly moves away from said motor and when said lead screw is rotated in a second direction the threaded assembly moves toward said motor; and at least one tension arm capable of interconnecting said lead screw assembly and said scissors-like structure;

wherein said threaded assembly is capable of being connected to said scissors-like structure such that rotating said lead screw in said first direction creates a tensile force in said tension arm and moves said platform away from said undercarriage.

2. Apparatus as in claim 1 wherein rotating said lead screw in said second direction moves said platform toward said undercarriage.

3. Apparatus as in claim 1 wherein said lead screw comprises a ball screw and said threaded assembly comprises a ball nut.

4. Apparatus as in claim 1 wherein said electric motor comprises a gear motor capable of being powered by a rechargeable battery.

5. A gurney comprising:

a platform having a top surface for holding a person and a bottom surface;

an undercarriage containing wheels; and means connecting said platform to said undercarriage, thereby to allow said gurney to be moved along the ground, said means connecting comprising:

an electric motor;

a lead screw assembly including a lead screw capable of being driven by said motor;

a scissors-like structure interconnecting said platform to said undercarriage;

a threaded assembly engaged with said lead screw and slidably mounted on said bottom surface such that when said lead screw is rotated in a first direction, the threaded assembly moves away from said motor and when said lead screw is rotated in a second direction the threaded assembly moves toward said motor; and at least one tension arm interconnecting said lead screw assembly and said scissors-like structure;

wherein said threaded assembly is connected to said scissors-like structure such that rotating said lead screw in said first direction creates a tensile force in said tension arm and moves said platform away from said undercarriage, and rotating said lead screw in said second direction moves said platform toward said undercarriage.

6. A power lifting unit apparatus for adjusting the height of a mobile patient transporter, the transporter having first and second side frame members, each side frame member having a lower end movably connected to a lower frame member, having an upper end movably connected to an upper frame member, and having a pivot point between said lower and upper ends, the first and second side frame members pivotally connected at the pivot point, the upper end of the first side frame member connected to a support arm, and the upper end of the second side frame member connected to a sliding arm, the power lifting unit apparatus comprising:

a housing capable of being mounted on the transporter;

an electric motor mounted on the housing and having a rotatable drive shaft;

a lead screw rotatably mounted on the housing and coupled to the drive shaft for rotation therewith;

a threaded member engaging the lead screw and being capable of being fixedly connected to the sliding arm, so that rotation of the lead screw is capable of causing the sliding arm to move parallel to the longitudinal axis of the lead screw; and a tension arm having a first end capable of being pivotally connected to the support arm, and having a second end pivotally connected to the housing near a first end of the housing;

wherein rotation of the lead screw in a first direction is capable of moving the sliding arm toward the first end of the housing and creating a tensile force in the tension arm, thereby pivoting the first and second side frame members about the pivot point and increasing the spacing between the upper and lower frame members.

7. Apparatus as in claim 6 wherein rotation of the lead screw in a second direction is capable of decreasing the spacing between the upper and lower frame members.

8. Apparatus as in claim 6 wherein the lead screw comprises a ball screw and the threaded member comprises a ball nut.

9. Apparatus as in claim 6 wherein the electric motor comprises a gear motor capable of being powered by a rechargeable battery.

10. Apparatus as in claim 6 in combination with the transporter, wherein the transporter comprises:

a lower frame member with a plurality of wheels rotatably mounted thereon;

a pair of first side frame members each having a lower end movably connected to the lower frame member near a first end of the lower frame member;

a pair of second side frame members each having a lower end pivotally connected to the lower frame member near a second end of the lower frame member;

an upper frame member pivotally connected to an upper end of each first side frame member near a first end of the upper frame member;

a support arm connected between the first side frame members near upper ends of the first side frame members;

a sliding arm connected between upper ends of the second side frame members, the sliding arm being slidably disposed with respect to the upper frame member;

wherein each side frame member has a pivot point between the lower and upper ends thereof, one of the first side frame members is pivotally connected to one of the second side frame members, and the other first side frame member is pivotally connected to the other second side frame member.

11. Apparatus as in claim 10 further comprising a bracket having a slot therein fixedly connected to the upper frame member near a second end of the upper frame member, wherein the sliding arm is slidably disposed within the slot.

12. Apparatus as in claim 10 further comprising a locking mechanism mounted on the upper frame member for securing the transporter in a stationary position.

13. A power lifting unit apparatus for adjusting the height of a mobile patient transporter, the transporter having a lower frame member with first and second wheels rotatably mounted near first and second ends thereof, a first side frame member having a lower end movably connected to the lower frame member near the first end of the lower frame member, a second side frame member having a lower end pivotally connected to the lower frame member near the second end of the lower frame member, an upper frame member pivotally connected to an upper end of the first side frame member near a first end of the upper frame member, a support arm connected to the first side frame member near the upper end of the first side frame member, a bracket having a slot therein fixedly connected to the upper frame member near a second end of the upper frame member, a sliding arm connected to an upper end of the second side frame member, the sliding arm being slidably disposed within the slot, and a locking mechanism mounted on the upper frame member for locking the sliding arm in a stationary position, wherein each side frame member has a pivot point between the upper and lower ends thereof, and the side frame members are pivotally connected at the pivot point, the power lifting unit apparatus comprising:

an electric motor mounted on a first housing and having a rotatable drive shaft;

a lead screw rotatably mounted on a second housing and coupled to the drive shaft for rotation therewith;

a threaded member engaging the lead screw and being capable of being fixedly connected to the sliding arm, so that rotation of the lead screw is capable of causing the sliding arm to move parallel to the longitudinal axis of the lead screw; and a tension arm having a first end capable of being pivotally connected to the support arm, and having a second end pivotally connected to the second housing near a first end of the second housing;

wherein rotation of the lead screw in a first direction is capable of moving the sliding arm toward the first end of the second housing and creating a tensile force in the tension arm, thereby pivoting the first and second side frame members about the pivot point and increasing the spacing between the upper and lower frame members.

14. Apparatus as in claim 13 wherein rotation of the lead screw in a second direction is capable of decreasing the spacing between the upper and lower frame members.

15. Apparatus as in claim 13 wherein the lead screw comprises a ball screw and the threaded member comprises a ball nut.

16. Apparatus as in claim 13 wherein the electric motor comprises a 12-volt d.c. gear motor.

17. Apparatus as in claim 13 in combination with the transporter, wherein the transporter comprises:

a lower frame member with first and second wheels rotatably mounted near first and second ends thereof;

a first side frame member having a lower end movably connected to the lower frame member near the first end of the lower frame member;

a second side frame member having a lower end pivotally connected to the lower frame member near the second end of the lower frame member;

an upper frame member pivotally connected to an upper end of the first side frame member near a first end of the upper frame member;

a support arm connected to the first side frame member near the upper end of the first side frame member;

a bracket having a slot therein fixedly connected to the upper frame member near a second end of the upper frame member;

a sliding arm connected to an upper end of the second side frame member, the sliding arm being slidably disposed within the slot; and a locking mechanism mounted on the upper frame member for securing the transporter in a stationary position;

wherein each side frame member has a pivot point between the upper and lower ends thereof, and the side frame members are pivotally connected at the pivot point.

18. Apparatus as in claim 17 wherein the support arm is fixedly connected to the first side frame member near the upper end of the first side frame member.

19. Apparatus as in claim 17 wherein the sliding arm is fixedly connected to the upper end of the second side frame member.

20. Apparatus as in claim 17 wherein the first side frame member has a lower end pivotally and slidably connected to the lower frame member near the first end of the lower frame member.

21. Apparatus as in claim 17 wherein a portion of the first side frame member between the lower end thereof and the pivot point is a telescoping portion which is adjustable in length.

22. A method for converting a mobile patient transporter by installing thereon a power lifting unit, the transporter having first and second side frame members, each side frame member having a lower end movably connected to a lower frame member, having an upper end movably connected to an upper frame member, and having a pivot point between said lower and upper ends, the first and second side frame members pivotally connected at the pivot point, the upper end of the first side frame member connected to a support arm, and the upper end of the second side frame member connected to a sliding arm, the method comprising the steps of:

providing a power lifting unit comprising an electric motor mounted on a housing and having a rotatable drive shaft; a lead screw rotatably mounted on the housing and coupled to the drive shaft for rotation therewith; a threaded member engaging the lead screw and being capable of being fixedly connected to the sliding arm, so that rotation of the lead screw is capable of causing the sliding arm to move parallel to the longitudinal axis of the lead screw; and a tension arm having a first end capable of being pivotally connected to the support arm, and having a second end pivotally connected to the housing near a first end of the housing; wherein rotation of the lead screw in a first direction is capable of moving the sliding arm toward the first end of the housing and creating a tensile force in the tension arm, thereby pivoting the first and second side frame members about the pivot point and increasing the spacing between the upper and lower frame members;

connecting the threaded member to the sliding arm; and pivotally connecting the first end of the tension arm to the support arm.

23. The method of claim 22 wherein rotation of the lead screw in a second direction is capable of decreasing the spacing between the upper and lower frame members.

24. The method of claim 22 wherein the lead screw comprises a ball screw and the threaded member comprises a ball nut.

25. The method of claim 22 wherein the electric motor comprises a gear motor capable of being powered by a rechargeable battery.

* * * * *